US005657977A

United States Patent [19]

Kato et al.

[11] Patent Number: 5,657,977

[45] Date of Patent: Aug. 19, 1997

[54] SHEET POST-PROCESSING APPARATUS

[75] Inventors: Katsuhito Kato, Kawasaki; Yoshifumi Takehara, Yokohama, both of Japan

[73] Assignee: Canon Kabushiki Kaisha, Tokyo, Japan

[21] Appl. No.: 385,703

[22] Filed: Feb. 8, 1995

[30] Foreign Application Priority Data

Feb. 8, 1994 [JP] Japan ..... 6-014411

[51] Int. Cl.[6] ..... B65H 39/00

[52] U.S. Cl. ..... 270/52.14; 270/52.16; 271/221

[58] Field of Search ..... 270/58.02, 58.04, 270/58.07, 58.08, 58.11, 58.12, 58.13, 58.15, 58.16, 58.17, 58.19, 58.14; 355/324; 271/221, 288, 185, 292, 293, 294

[56] References Cited

U.S. PATENT DOCUMENTS

| | | | |
|---|---|---|---|
| 3,774,906 | 11/1973 | Fagan et al. | 270/58.16 X |
| 3,910,568 | 10/1975 | Brown et al. | 271/221 |
| 3,995,748 | 12/1976 | Looney | 270/58.14 X |
| 4,095,782 | 6/1978 | Breuers et al. | 271/292 |
| 4,208,122 | 6/1980 | Iwamoto et al. . | |
| 4,411,515 | 10/1983 | Kukucka et al. | 355/324 X |
| 4,709,915 | 12/1987 | Ishikawa et al. | 271/288 |
| 4,965,629 | 10/1990 | Hiroi et al. | 270/58.02 X |
| 5,092,509 | 3/1992 | Naito et al. | 270/58.16 X |
| 5,192,065 | 3/1993 | Hirota et al. . | |
| 5,282,611 | 2/1994 | Ueda et al. . | |
| 5,384,634 | 1/1995 | Takehara et al. | 355/324 X |

FOREIGN PATENT DOCUMENTS

| | | | |
|---|---|---|---|
| 57-156957 | 9/1982 | Japan | 270/58 |
| 6-199466 | 7/1994 | Japan | 271/294 |

OTHER PUBLICATIONS

Xerox Disclosure Journal, Telescoping Sorter Bin, Stemmle, D.J., vol. 10 No. 5 Sep. 1985.

*Primary Examiner*—John T. Kwon

*Attorney, Agent, or Firm*—Fitzpatrick, Cella, Harper & Scinto

[57] ABSTRACT

A sheet post processing apparatus includes at least one sheet accommodating device for accommodating sheets; a sheet discharging device for discharging sheets to the sheet accommodating device; a transfer device for transferring a set of sheets on the sheet accommodating device to a sheet take-out position; and a manual control device for operating the transfer device.

57 Claims, 15 Drawing Sheets

SHEET POST-PROCESSING APPARATUS

FIELD OF THE INVENTION AND DESCRIPTION OF THE RELATED ART

The present invention relates to a sheet post processing apparatus, and more particularly, to a sheet post processing apparatus having a binding means for post processing sheets, such as copy sheets, that have been sorted and/or accommodated in bin trays after being discharged from a copying machine, printing machine, laser beam printer or another image forming apparatus.

A conventional copying machine is provided with a sorter by which the discharged sheets can be sorted in the order of pages by moving the bins up and down.

In such a sorter, a group of bins are moved during the sorting operation from a low position adjacent to the floor to a high position away from the floor and in the opposite direction. At the end of the sorting operation, the group of bins takes either low or high position, and in the former case, the operativity of taking the sheets out is not good. Conventionally, therefore, the operativity is improved by automatically moving the group of bins to the high position after the end of the sorting operation if the group of bins is not at the high position.

Generally, a stapling sorter which can staple the sorted sheets, is operable in a sorting mode, non-sorting mode, grouping mode, and in addition, sorting-stapling mode. However, sets of sheets sorted in the sorting mode can be automatically stapled by actuating a manual stapling key provided in the stapling sorter.

If the group of bins is automatically moved to the high position, the following complicated and non-efficient operations are required. That is, if the operator attempts to staple the sorted sets of sheets, the group of bins moves to the bottom most position from the topmost position to permit stapling operations for each set of sheets, and then, the group of bins is moved to the topmost position to facilitate taking-out operation.

Some apparatuses are provided with a sheet set transferring means for moving the sheets to an easy-take-out position immediately after the sheets are sorted. In this case, the manual stapling operation is not possible.

SUMMARY OF THE INVENTION

Accordingly, it is one object of the present invention to provide a sheet post processing apparatus which is provided with a binding means and which is good in the operativity thereof.

According to one aspect of the present invention, there is provided a sheet post processing apparatus comprising at least one sheet accommodating means for accommodating sheets; sheet discharging means for discharging sheets to the sheet accommodating means; transfer means for transferring a set of sheets on the sheet accommodating means to a sheet take-out position; binding means for binding sheets; automatic control means for operating, in an automatic binding mode, the transfer means after operating the binding means after an end of sheet discharge; and manual control means for operating, in a non-automatic binding mode, the transfer means after operating the binding means.

According to these features, the sheet set transfer, and/or bin shift-up is carried out properly in accordance with a selected sheet discharge mode after sheet discharge. Therefore, the recovery is possible, even if the operator forgets the selection of the stapling mode. In addition, the desired mode can be quickly carried out, and furthermore, the operativity of the sheet taking-out operation is significantly improved.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
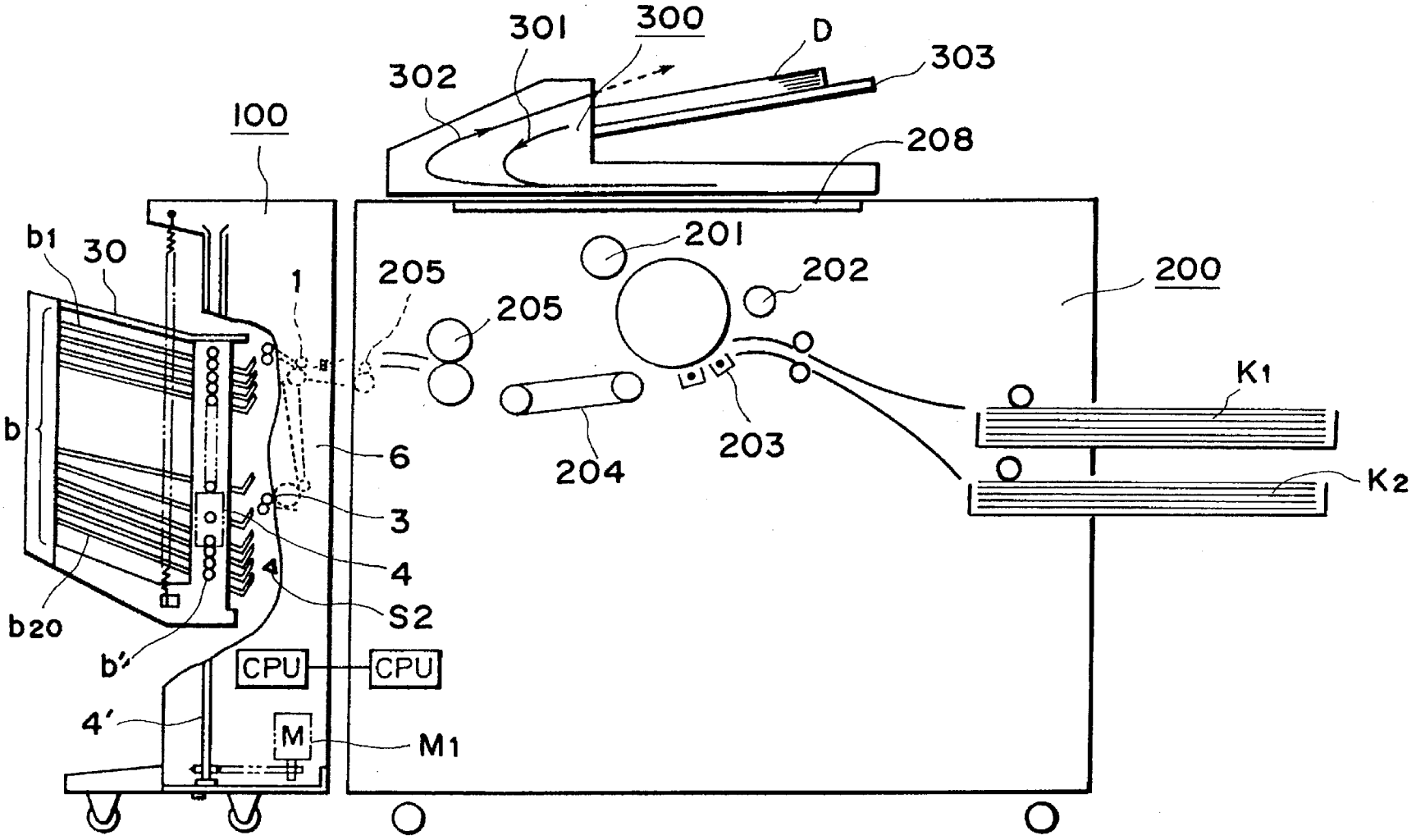
FIG. 1 is a front view of a copying machine provided with a sorter.

FIG. 1 shows a general arrangement of a sheet post processing apparatus according to an embodiment of the present invention. As shown in FIG. 1, an automatic document feeder 300 for automatically circulating original documents, is provided on a top of the main assembly of the image forming apparatus. At a downstream side, there is provided a sorter 100 having 20 bin trays (b1, b2, . . . b20).

The image forming apparatus is a known electrophotographic type, and therefore, the description of the image forming process of the apparatus is omitted for simplicity. Briefly, an image of an original placed at a predetermined position an a platen glass 208 is formed on a photosensitive drum 201 through an unshown optical system, and the image is developed by a developing device disposed adjacent the photosensitive drum, and the developed image is transferred onto a sheet by a transfer electrode 203. The transferred image is fixed by a fixing device 205 into a permanent image.

A sorter 100 is a bin-movable type sorter, and bin trays b arranged vertically are movable step by step up and down by one full-rotation of helical cams 4 supported on cam shafts 4' provided at opposite ends, wherein trunnions b" are moved up and down along the helical grooves. The cams 4 movement is controlled by a motor M under the control of a CPU, as disclosed in U.S. Pat. No. 5,092,509.

Figure 7:
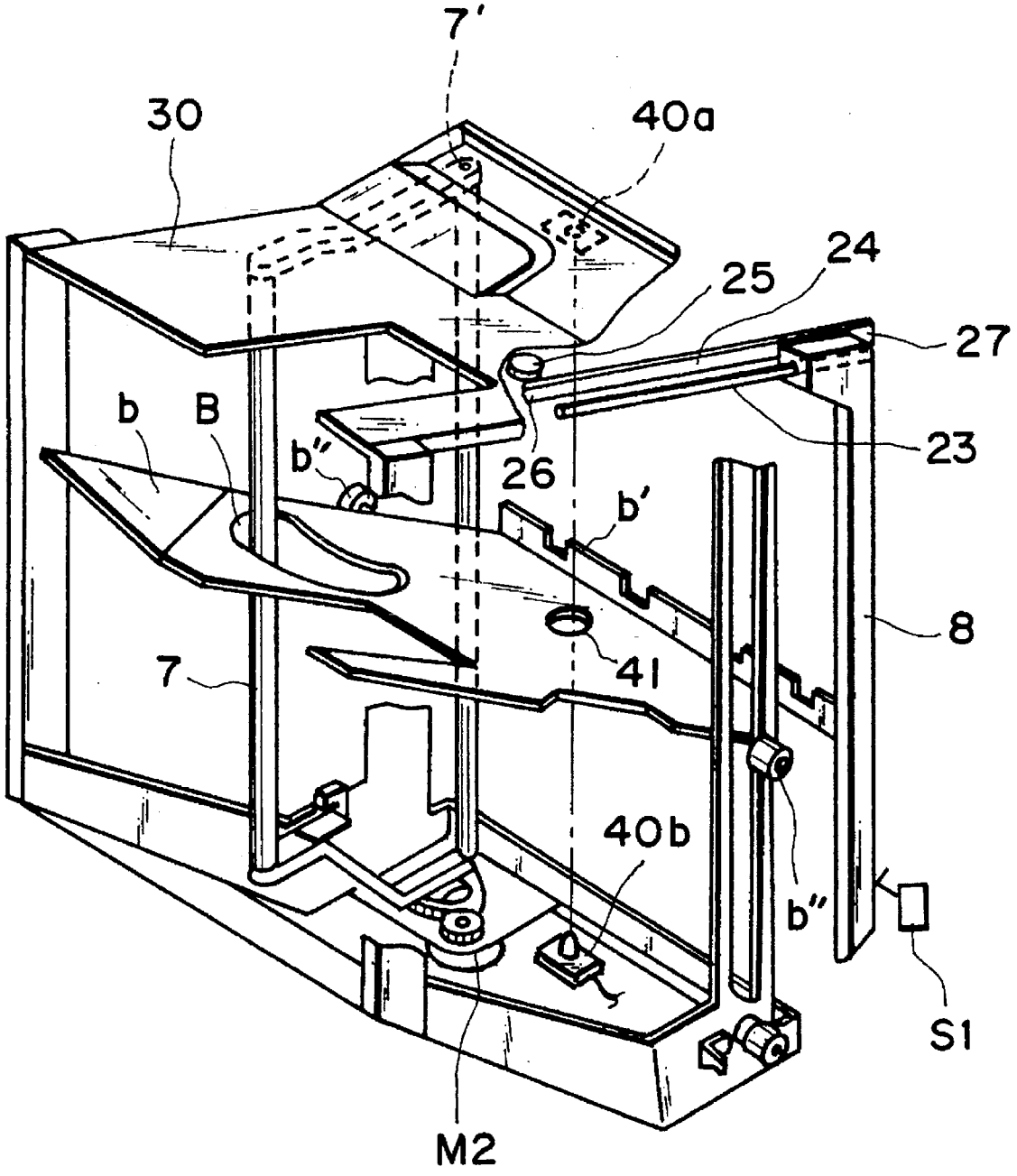
FIG. 7 is a perspective view of a major part of the sorter of FIG. 1.

The sheet having an image formed thereon by the main assembly 200 of the image forming apparatus, is fed to sorter 100 through a pair of discharging rollers 205, and is directed to either a sorting path or non-sorting path by a flapper 1. In the non-sorting mode, all the sheets are passed through the non-sorting path, and are discharged to a non-sorting tray 30. In the sorting mode, the sheets are passed through the sorting path, and the sheets are received by bin trays moving up or down synchronously with the sheet discharge by the discharging roller 3. A transmitting type photosensor constituted by elements 40*a* and 40*b* functions to detect the presence or absence of the sheet on the bin through a hole 41 (FIG. 7). In this embodiment, the position of the group of bins is a home position when the topmost bin b1 is opposed to the sheet discharging position. The main assembly of the sorter 100 is provided with a counter for counting which bin is opposed to the sheet discharging position, so that the position of the bin group can be known upon the end of the sheet discharge.

Designated by a reference numeral 9 (e.g., FIG. 2) is an electric stapler for stapling the sheets by an upper head driven by a motor and a lower anvil. It is disposed at a predetermined position (solid line) opposed to the bin tray b, and is movable to a stapling position indicated by broken lines. The movement is effected and controlled by an unshown motor (FIG. 2), as described in detail in the above-mentioned U.S. patent.

Figure 2:
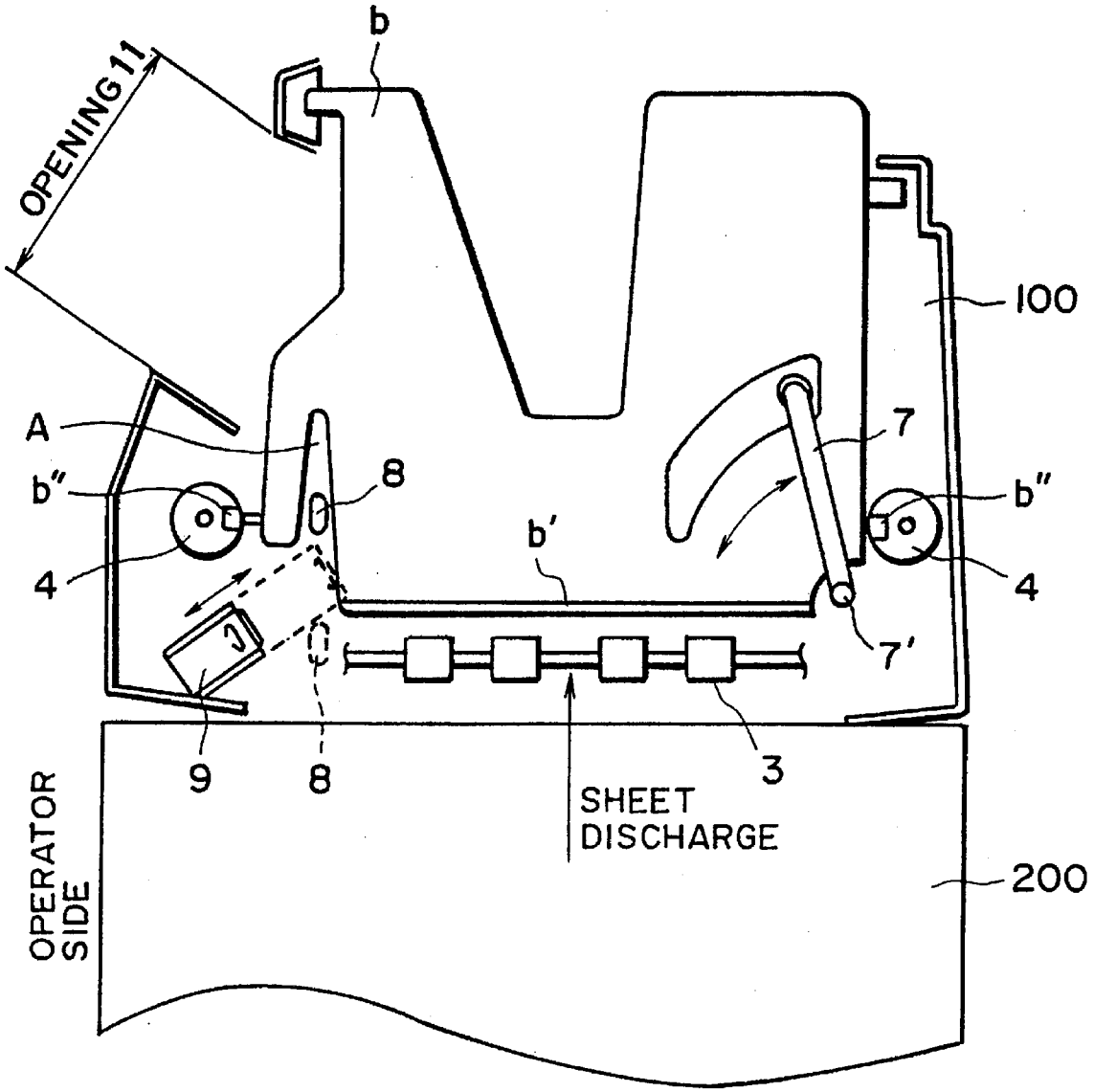
FIG. 2 is a top plan view of the sorter.
Figure 4:
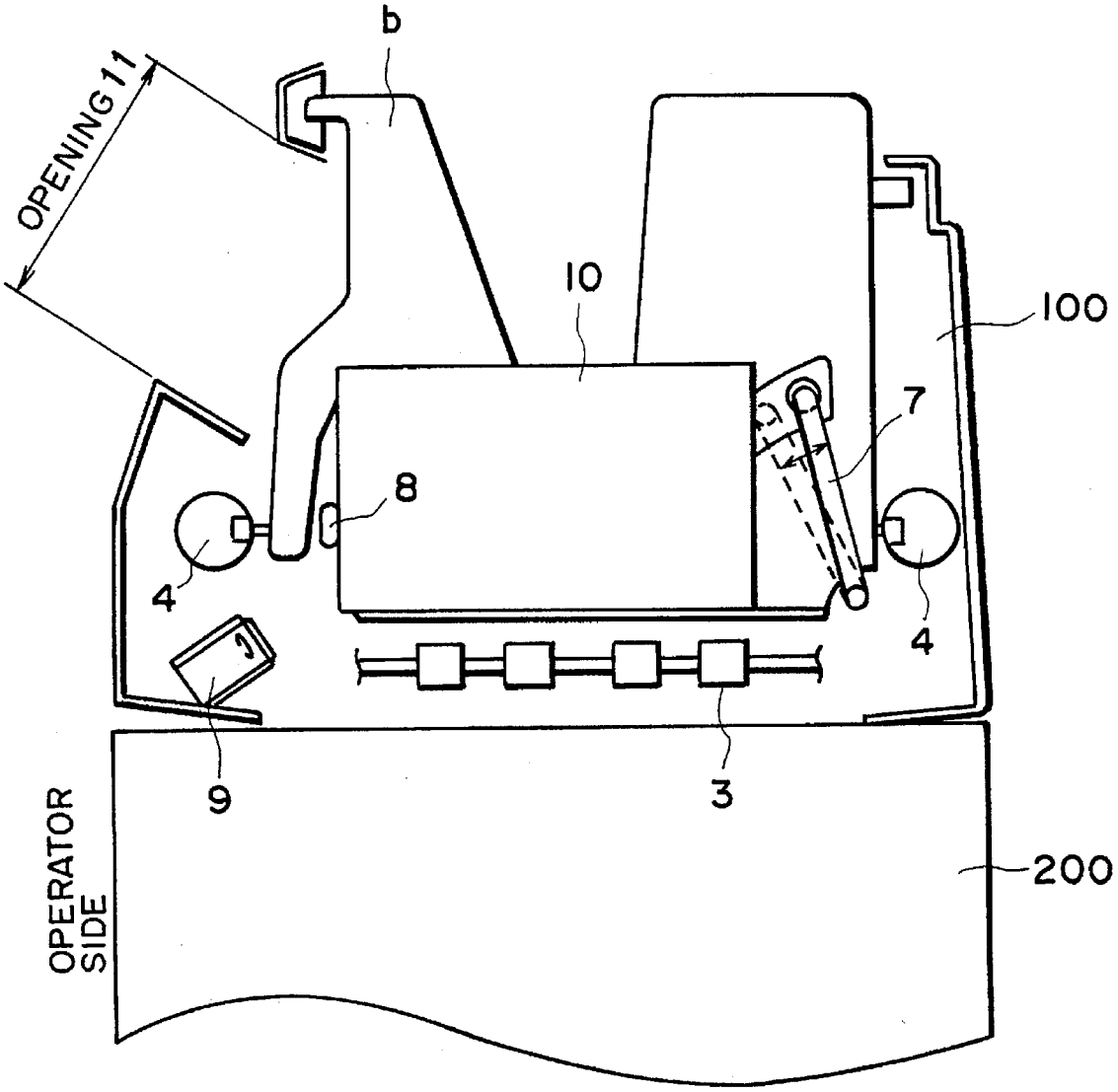
FIG. 4 illustrates operation of the apparatus of FIG. 2.

FIG. 2 is a top plan view of the sheet post processing apparatus 100. The sheet 10 is discharged at a part of the image forming apparatus 200, and is received by the sorter 100, and is then discharged to a bin tray b by the rollers 3 in the apparatus (FIG. 4).

Referring to FIG. 2–5, the description will be made as to alignment and movement of the sheet thereafter.

When the sheet 10 is discharged to bin tray b, the sheet 10 is aligned to a reference rod 8 by reciprocal motion of an aligning rod 7 driven by a motor M2 (FIG. 7). Until all the sheets are discharged, the operation is repeated for each sheet (FIG. 4). The aligning rod 7 is supported by shaft 7'.

Figure 3:
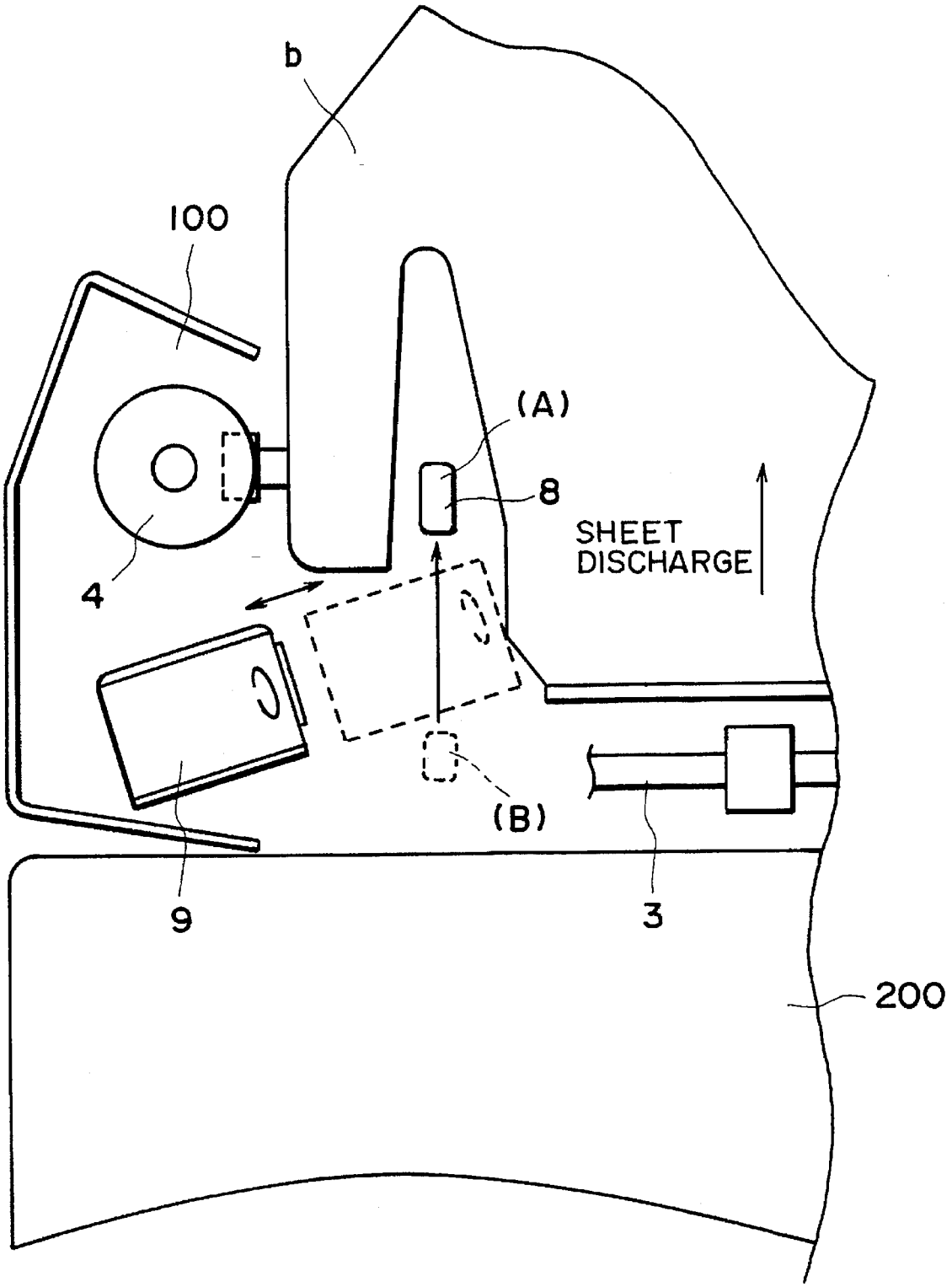
FIG. 3 is an enlarged top plan view of a major part in FIG. 2.
Figure 5:
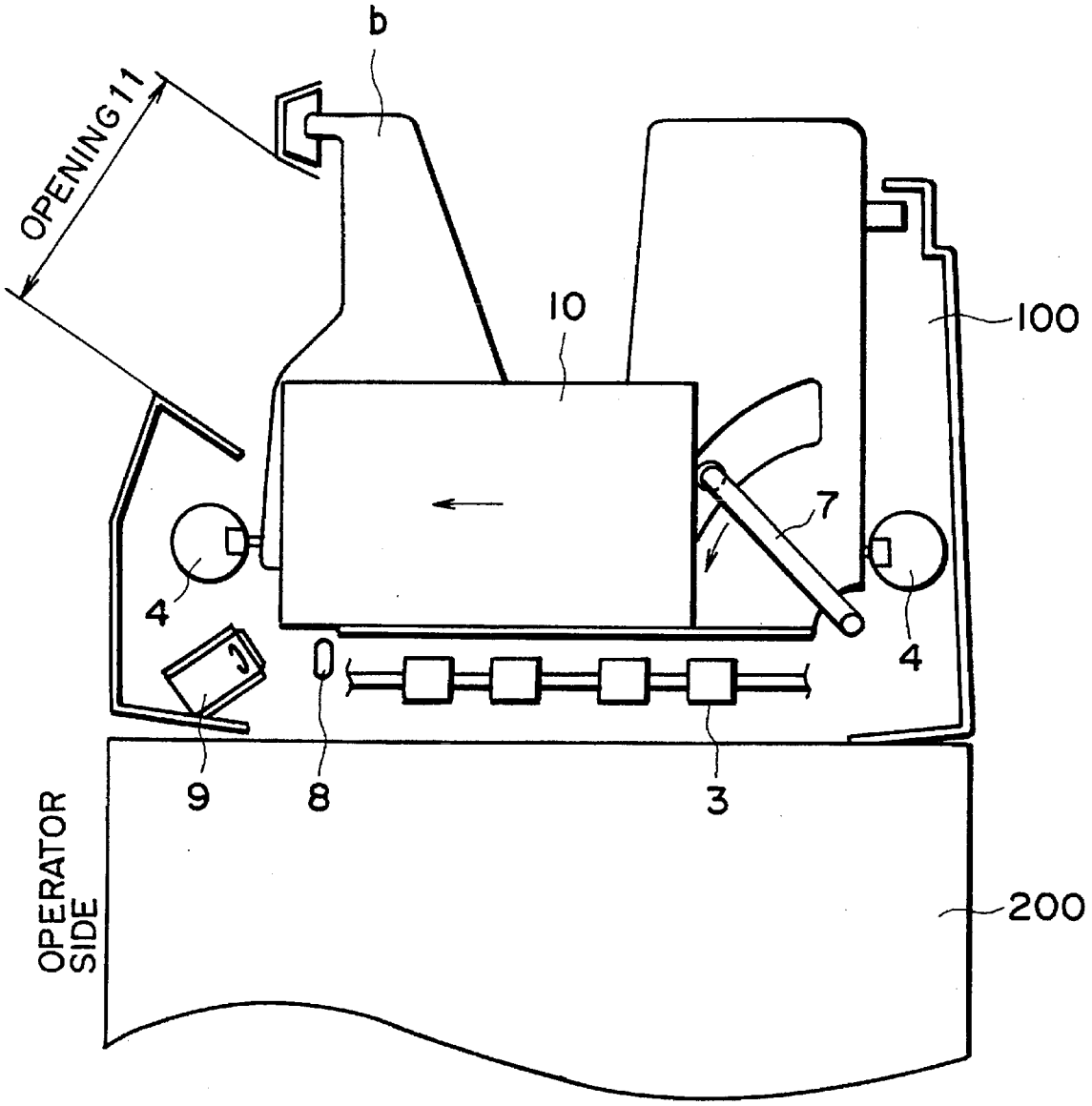
FIG. 5 illustrates operation of the apparatus of FIG. 2.
Figure 6:
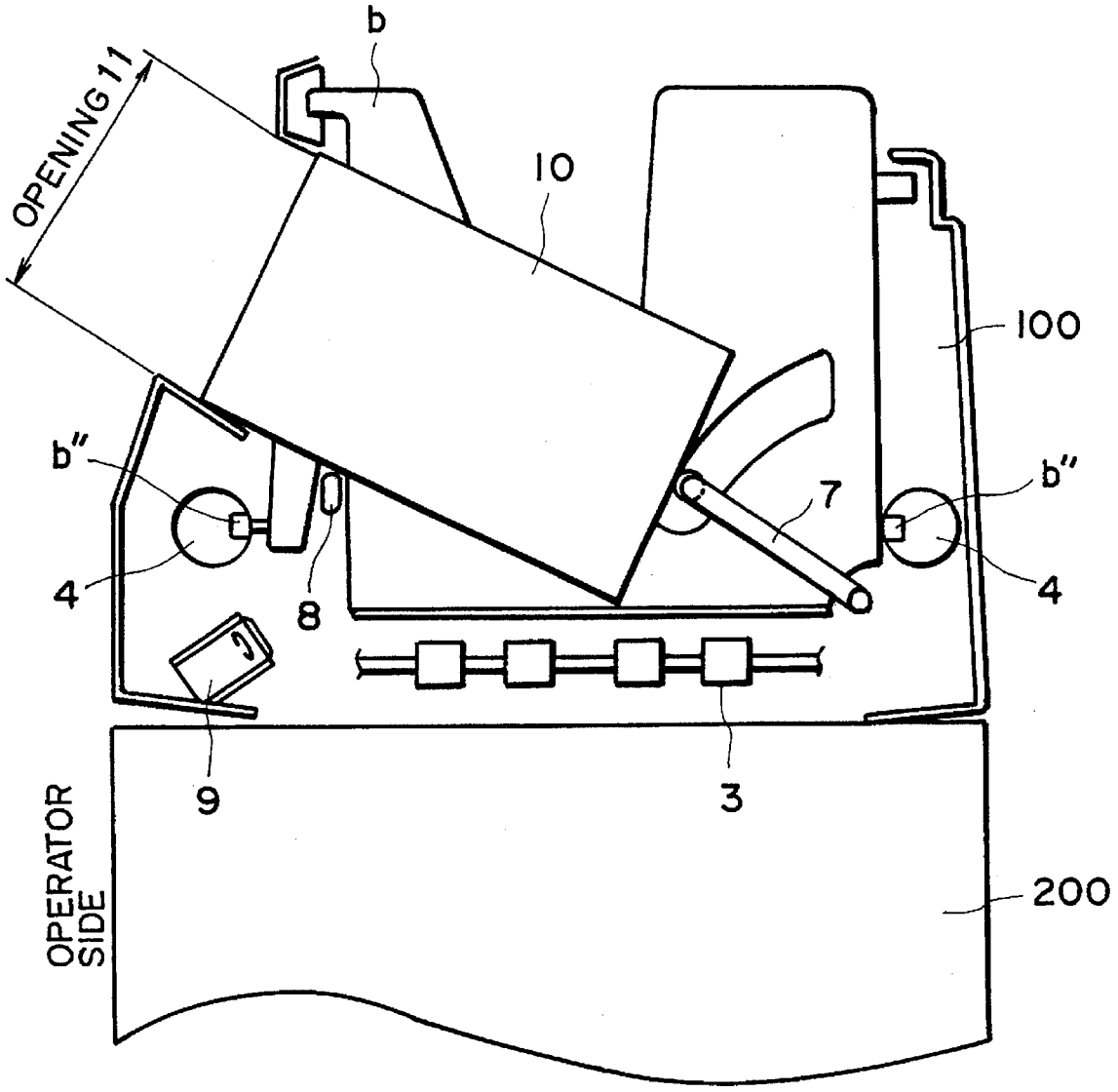
FIG. 6 illustrates operation of the apparatus of FIG. 2.

In this embodiment, the reference rod 8 is moved to a position (A) which is a reference position to provide a reference surface in FIG. 3. When the sheet 10 is moved on the bin tray b to permit the operator to take the sheet 10 out from the operator side, the reference rod 8 is retracted from the inside of the bin tray b. At this time, the reference rod 8 moves toward a position bin tray b and is retracted to an outside of the bin tray b, so that all the discharged sheets are pushed toward the operator (FIG. 5). After pushing to a predetermined extent, the aligning rod 7 stops, and thereafter, the reference rod 8 moves to raise a corner of the sheet, thus inclining the sheet relative to the bin tray. Then, the aligning rod 7 is moved again to move the sheet. Thus, the sheet is moved to an opening adjacent the operator, thus facilitating the operator's taking out action at the operator side of the apparatus (FIG. 6).

The reference rod 8 has dual functions, i.e., to provide a reference plane for the discharged sheets, and to push the sheets.

Referring to FIG. 7, the reference rod 8 will be described in detail.

Opposed to the aligning rod 7, the reference rod 8 is disposed extending through cut-away portions of the bin trays b. The reference rod 8 extends in a sheet discharging direction, and is engaged with a guide rail 23 supported below a non-sorting tray 30, and one end thereof is fixed on a belt 24 stretched in parallel with the guide rail 23. The belt 24 is trained around a pulley 26 of a pulse motor 25 fixed below the non-sorting tray 30 and an idler pulley 27. Thus, by forward and backward rotations of the motor 25, the reference rod 8 is moved between a home position (B) where the reference rod 8 is retracted out of the bin tray area (behind the stopper b') and an operative position (A) for aligning the sheets and pushing them. The detection for position (B) is effected by a sensor S1, and position (A) is effected on the basis of the pulse input to the pulse motor 25.

The description will be made as to the operation in each sheet discharging mode.

Figure 8:
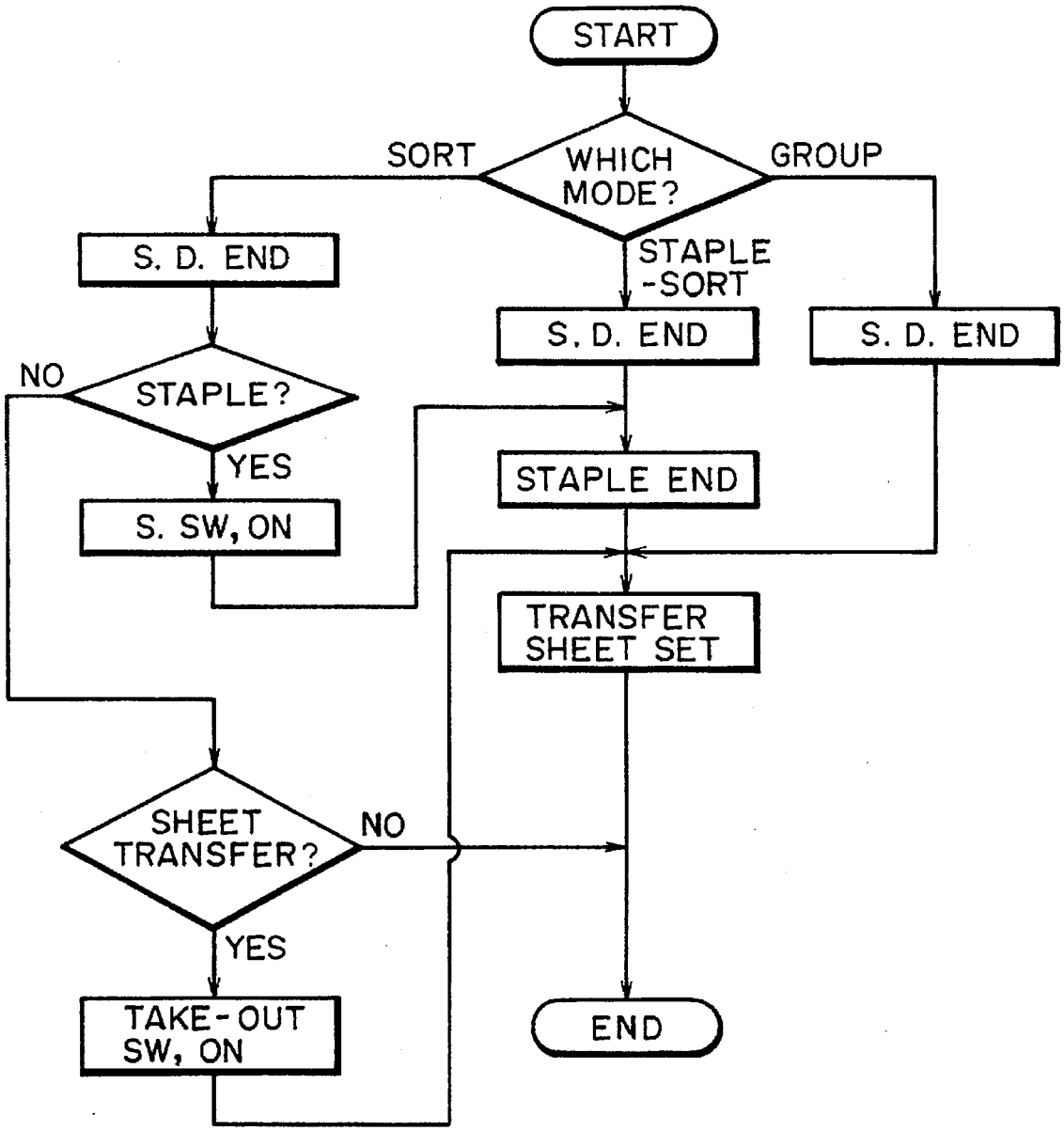
FIG. 8 is a flow chart of operation of the apparatus in accordance with a first embodiment.

Referring to FIG. 8, in a sorting mode wherein the sheets are automatically stapled after the sorting, the bin trays b are moved up or down step by step sequentially, after the end of the discharge of the last sheet, and during the movement the stapler 9 staples the sheet set on each bin. After the stapling, the sets of sheets thus stapled are moved together to an opening 11. In detail, when the bin tray b is moved by one step, the stapler 9 is entered and staples the sheets, and then, the stapler returns. Thereafter, the bin tray is moved further by one step, the stapler 9 enters again to staple the next set of sheets, and the stapler 9 returns. This is repeated so that the sheets are stapled step by step.

In the sorting mode, after the sheet discharge, the sets of sheets are taken out, and are placed in the stand-by state until the sheet sensors 40*a* and 40*b* are reset. If the user wishes to staple during this period, on an operation panel of the sorter is actuated. Then, the bin trays move up or down step by step, and the stapler operates for each bin tray to sequentially staple the sets of sheets. After the end of stapling, the stapled sheet sets are transferred to the take-out opening 11 in the manner described above. When the operator wants to transfer the sheet to the take-out opening 11 without stapling during the stand-by state, a manual take-out switch is actuated by the operator, in response to which the aligning rod 7 and reference rod 8 are operated to push or transfer the sheet sets to the take-out opening 11.

In the grouping mode, the sheet sets are transferred to the take-out opening 11 automatically through the above-described manner after the end of the sheet discharge.

Figure 12:
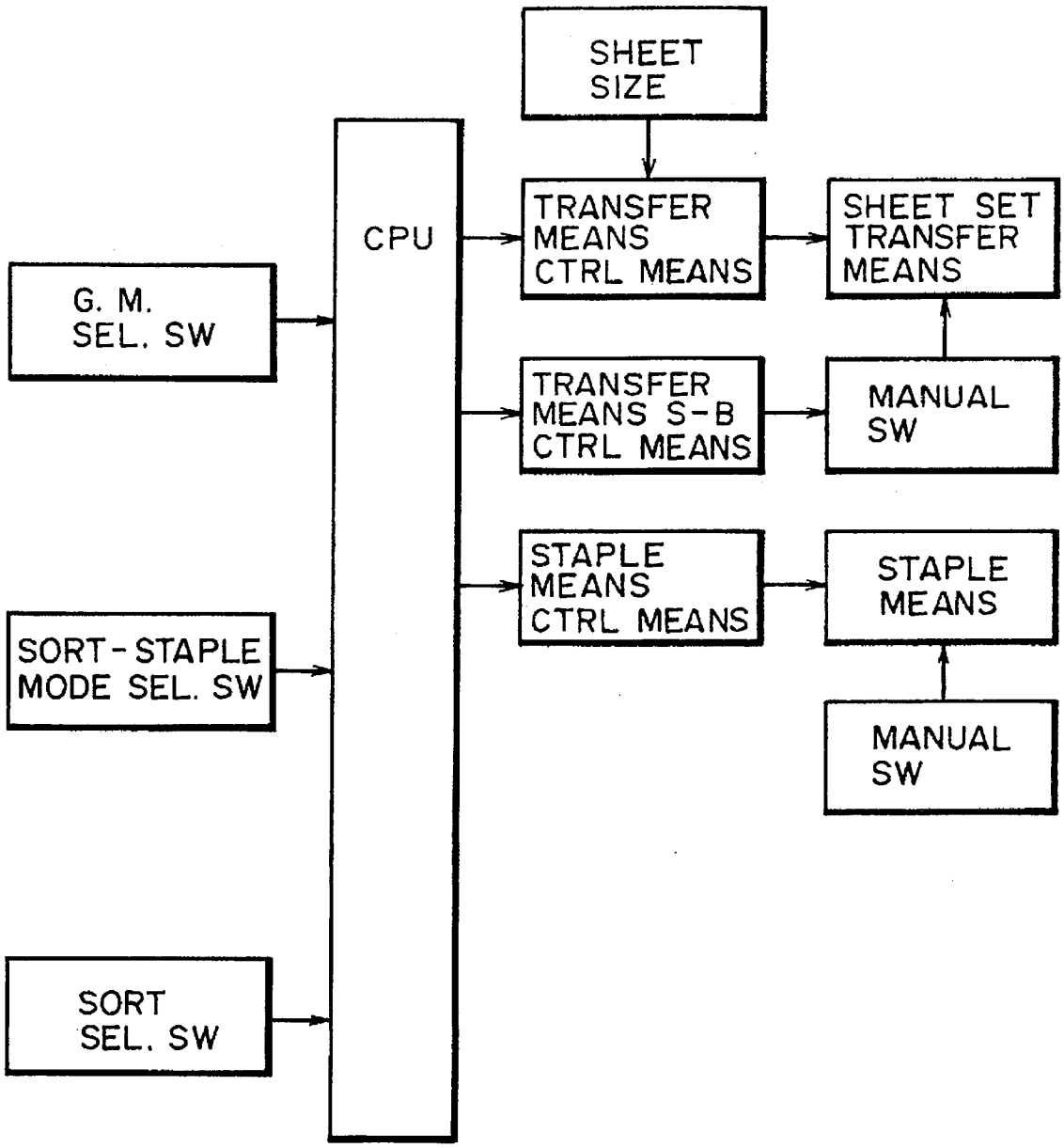
FIG. 12 is a block diagram according to a first embodiment.

With such a structure, any mode of operations can be carried out speedily. The block diagram of the operation is shown in FIG. 12.

Figure 10:
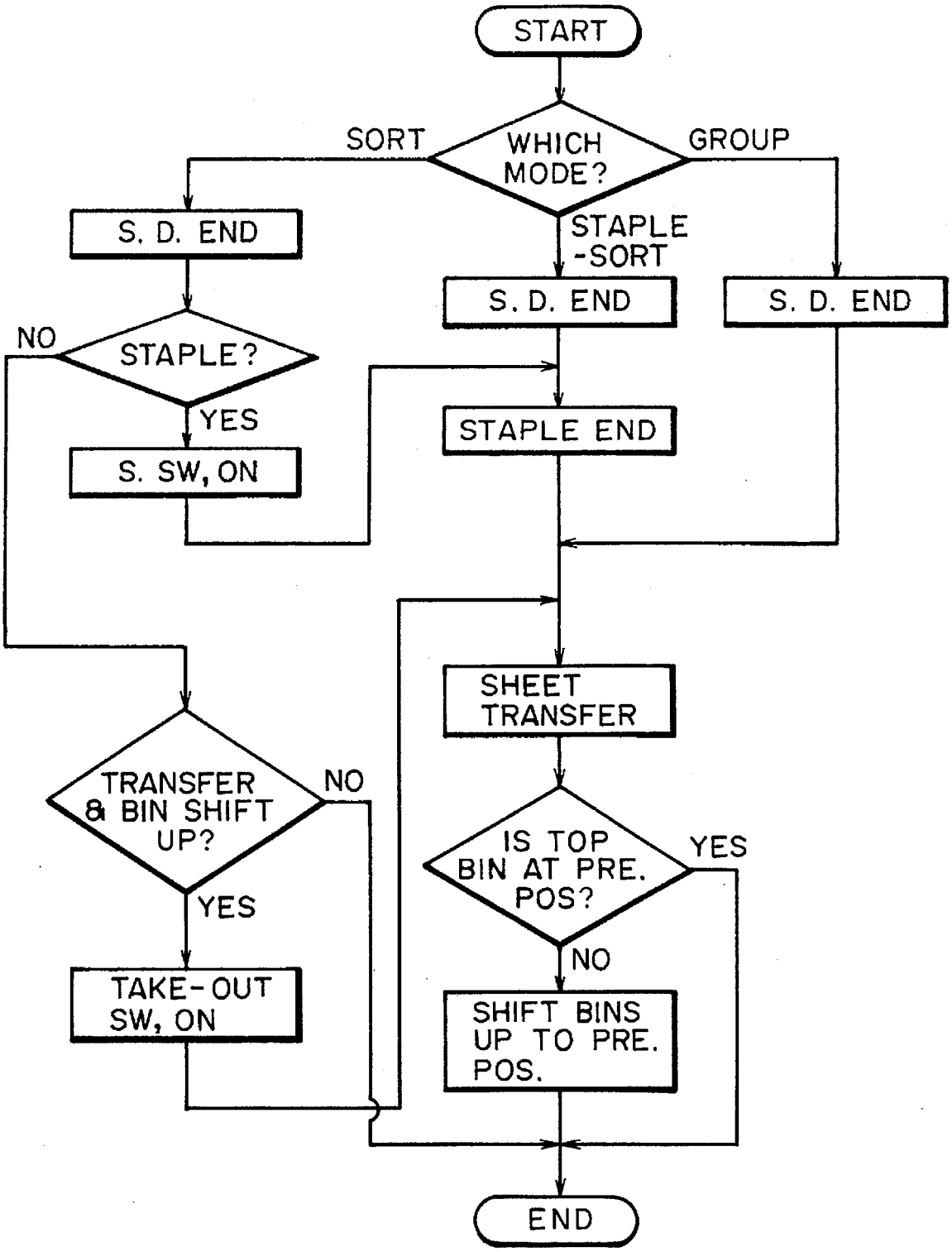
FIG. 10 is a flow chart of operation of the apparatus in accordance with a second embodiment.

Referring to FIG. 10, a second embodiment will be described.

In the second embodiment, the bins are shifted up to further enhance the sheet taking-out operativity. In the staple-sort mode, the stapler 9 sequentially staples the sheets after the end of the sheet discharge, and the sheet sets are automatically transferred to the take-out opening 11 through the above-described manner. Using the bin position counter, the discrimination is made as to whether or not the group of bins takes the topmost position. If not, the lead cams 4 are operated to rotate to shift the bin group to the topmost position.

In the sorting mode, the stand-by state is established after the discharge of the sheets. When the operator wants to staple sheets, the stapling switch 4 is actuated to operate the stapler 9. After the stapling, the set of sheets is automatically transferred to take-out opening 11 through the above-discussed manner. When the bin position counter (or sensor S2) detects that the bin group is not at the topmost position, the lead cam 4 rotates to shift the bin group up to the topmost position. When the operator wants to transfer the sheets to the take-out opening 11 without stapling and to shift the bins up, the operator actuates the sheet take-out switch, the sheets sets are transferred in the manner described above, and thereafter, the bins are shifted up to the topmost position.

In addition, in the grouping mode, the above-described operation is carried out automatically, after the sheet discharge.

Figure 13:
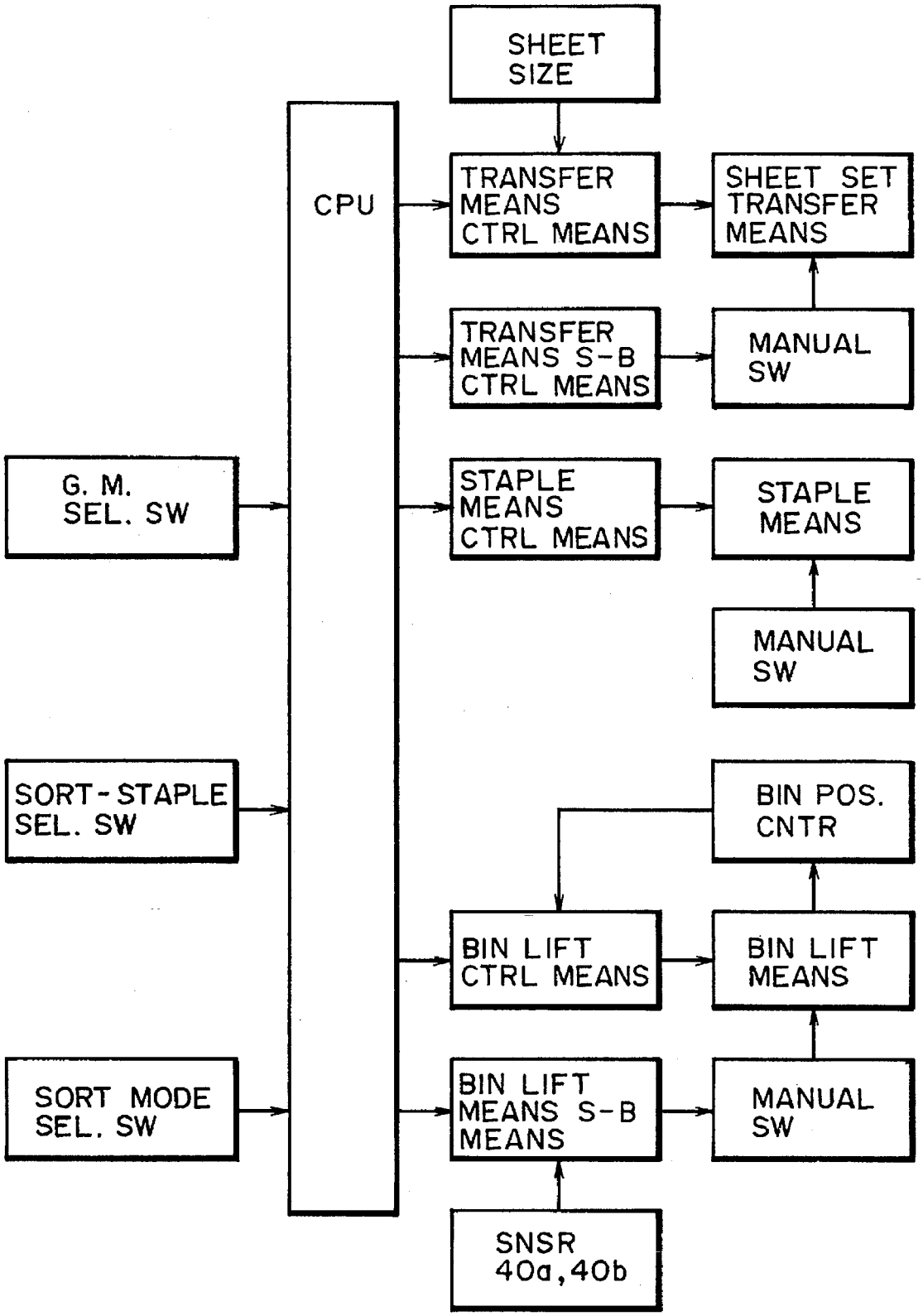
FIG. 13 is a block diagram according to a second embodiment.

With the above-described structure, any mode of operations can be effected as desired by the operator without conventional wasteful and cumbersome operations. So, the operativity of the sheet set taking-out operation is significantly improved. The block diagram operations are shown in FIG. 13.

Figure 9:
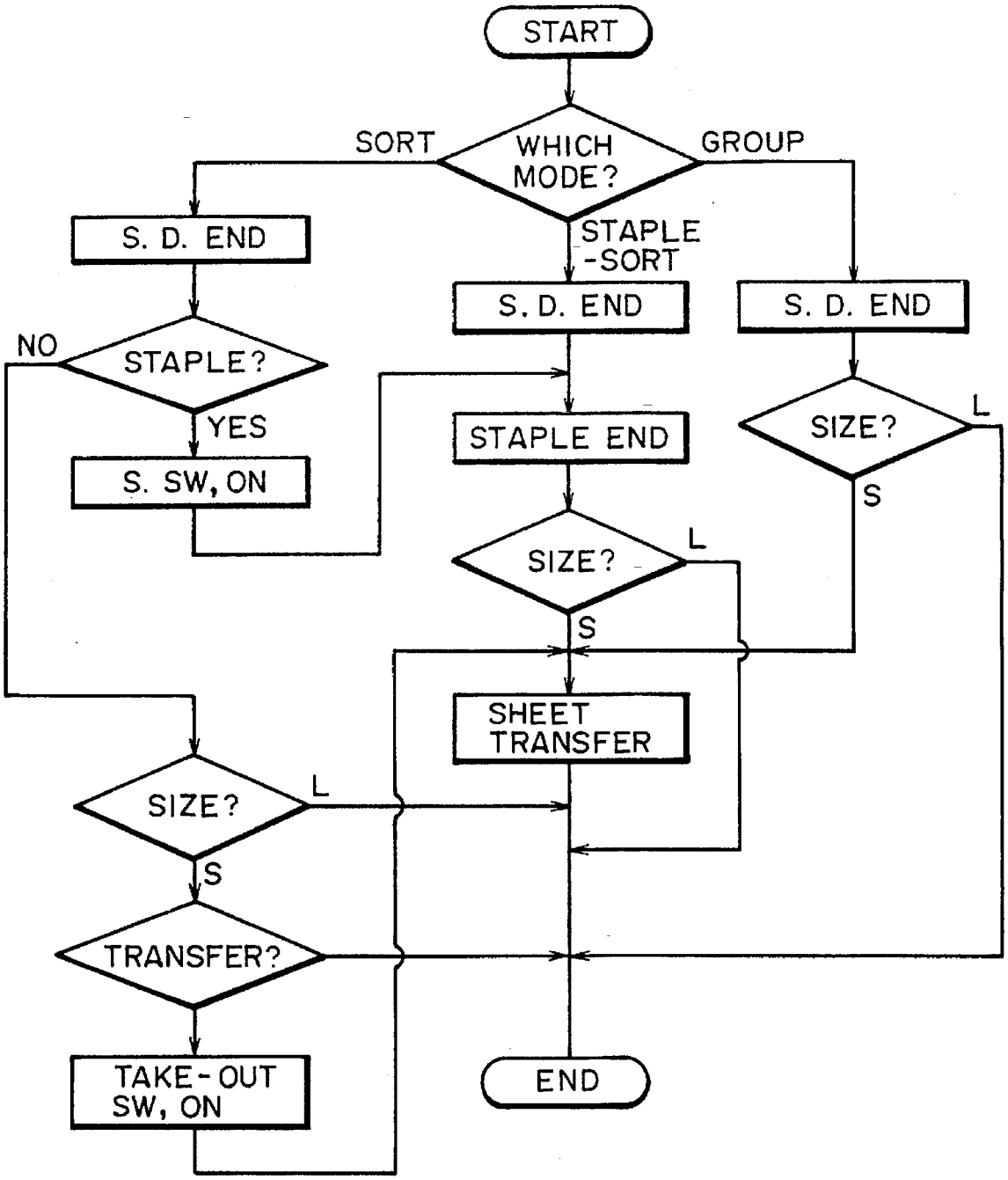
FIG. 9 is a flow chart of operation of the apparatus in accordance with a first embodiment (FIG. 8).
Figure 11:
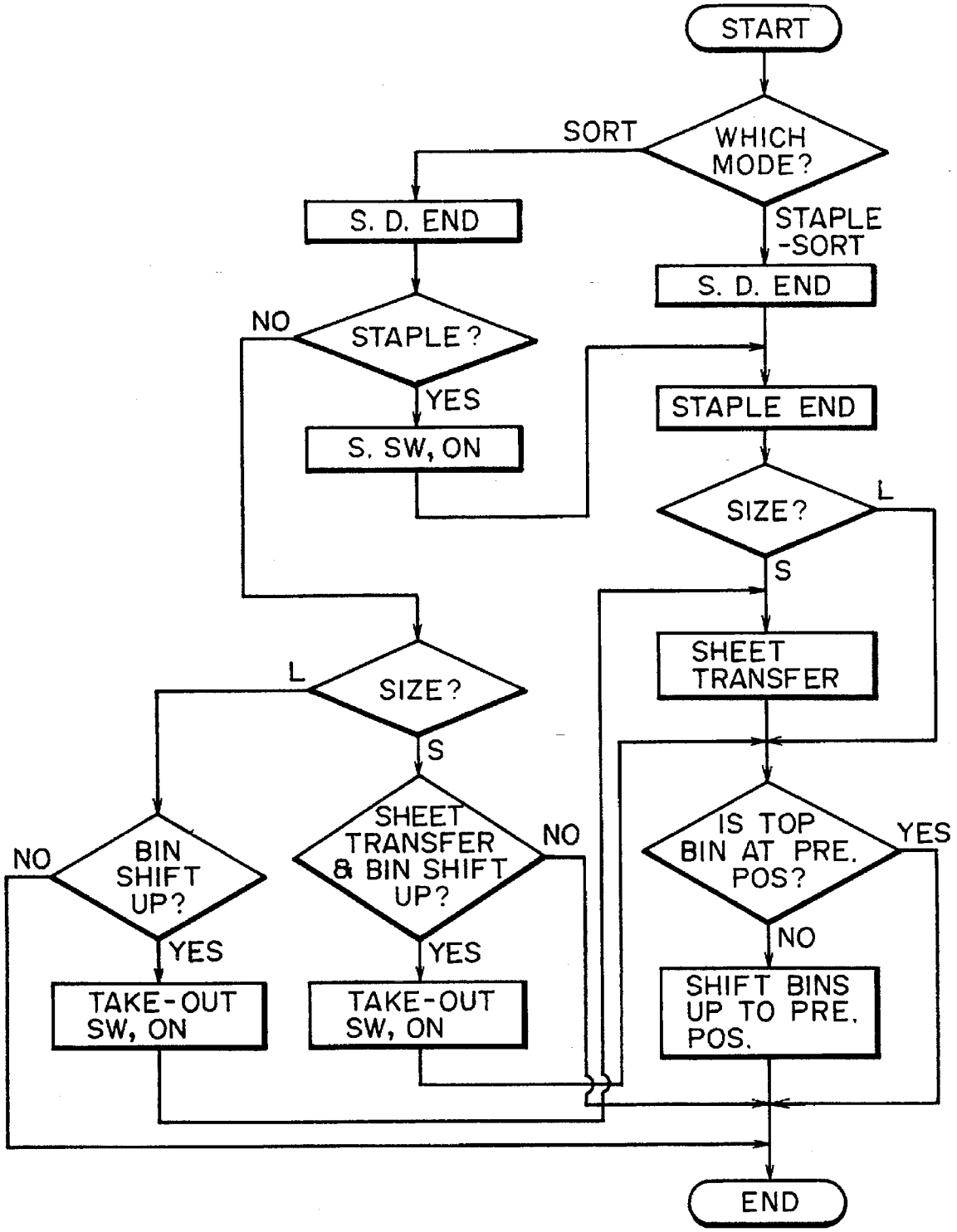
FIG. 11 is is a flow chart of operation of the apparatus in accordance with a third embodiment (FIG. 10).

Referring to FIGS. 9 and 11, a third embodiment will be described. This embodiment is advantageous in that the size of the apparatus can be reduced. In this embodiment, the size of the sheet transferred to the take-out opening 11 is limited to a relatively small size, such as A4, letter size or the like, and the transfer of the large size sheet is prevented although the shifting-up of the bins is permitted. When the large size sheets are transferred to permit them to be taken out at the operator's side, the width of the take-out opening 11 is required to be quite large. By limiting to the small size, the width of the take-out opening 11 can be, for example, one half so that the downsizing of the apparatus is possible. The operations of various part of the apparatus of this embodiment are the same as described in the foregoing embodiment, and therefore, the detailed description is omitted for simplicity. As means for inputting the size information, manual size input means, automatic size detector in cassettes K1 and K2, or the like are usable.

Figure 14:
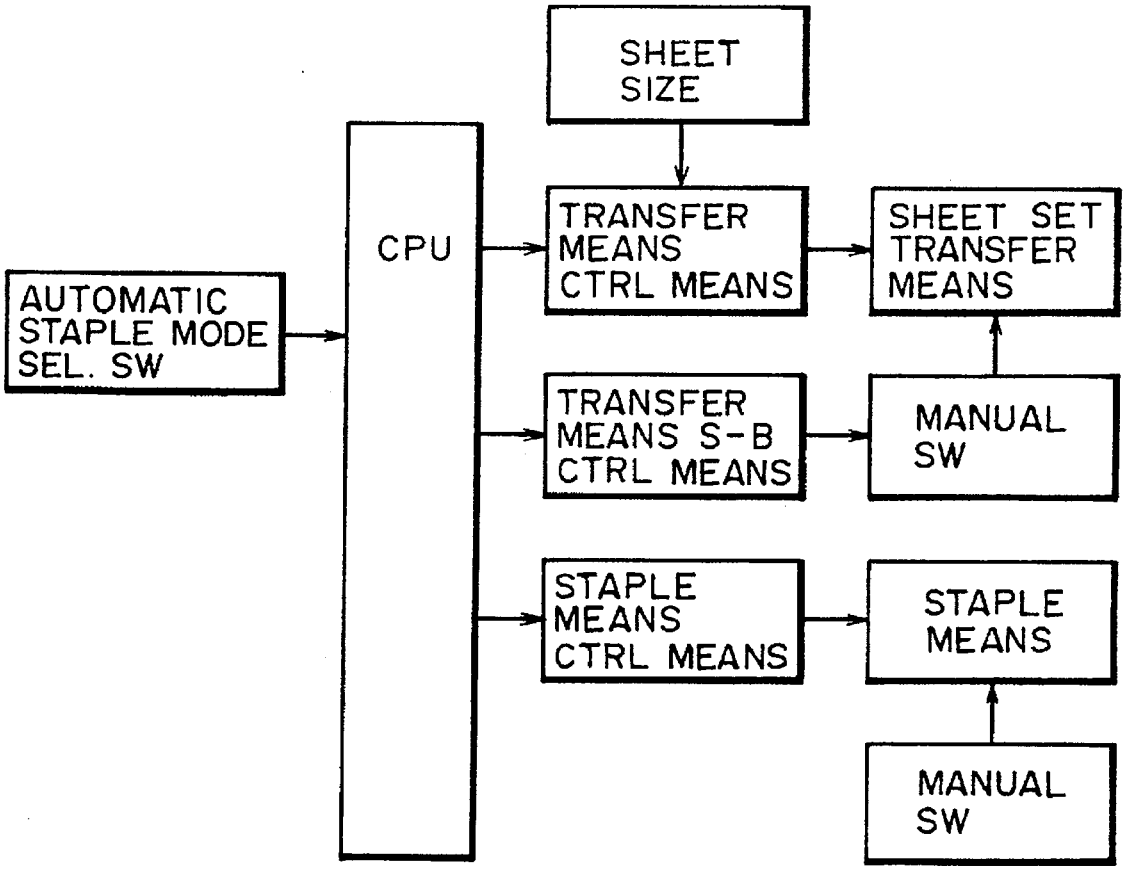
FIG. 14 is a block diagram according to another embodiment.

In the foregoing the description has been made with respect to the sorter, but the present invention is applicable to a finisher having one tray. In this case, sheet set transfer means and stapling means are provided, and sheet set transfer means stand-by control means is also provided to prevent automatic operation of the sheet set transfer means. After the manual stapling, the sheet sets are manually transferred to an easy take-out position. When the sheet sets are taken out, a sensor detect the event and the stand-by state is reset. The block diagram of the system of this embodiment is shown in FIG. 14.

In the case of sorters, the transfer means is not always inevitable, and it is an alternative to provide stand-by state control means to prevent automatic bin moving means to an easy take-out position.

Figure 15:
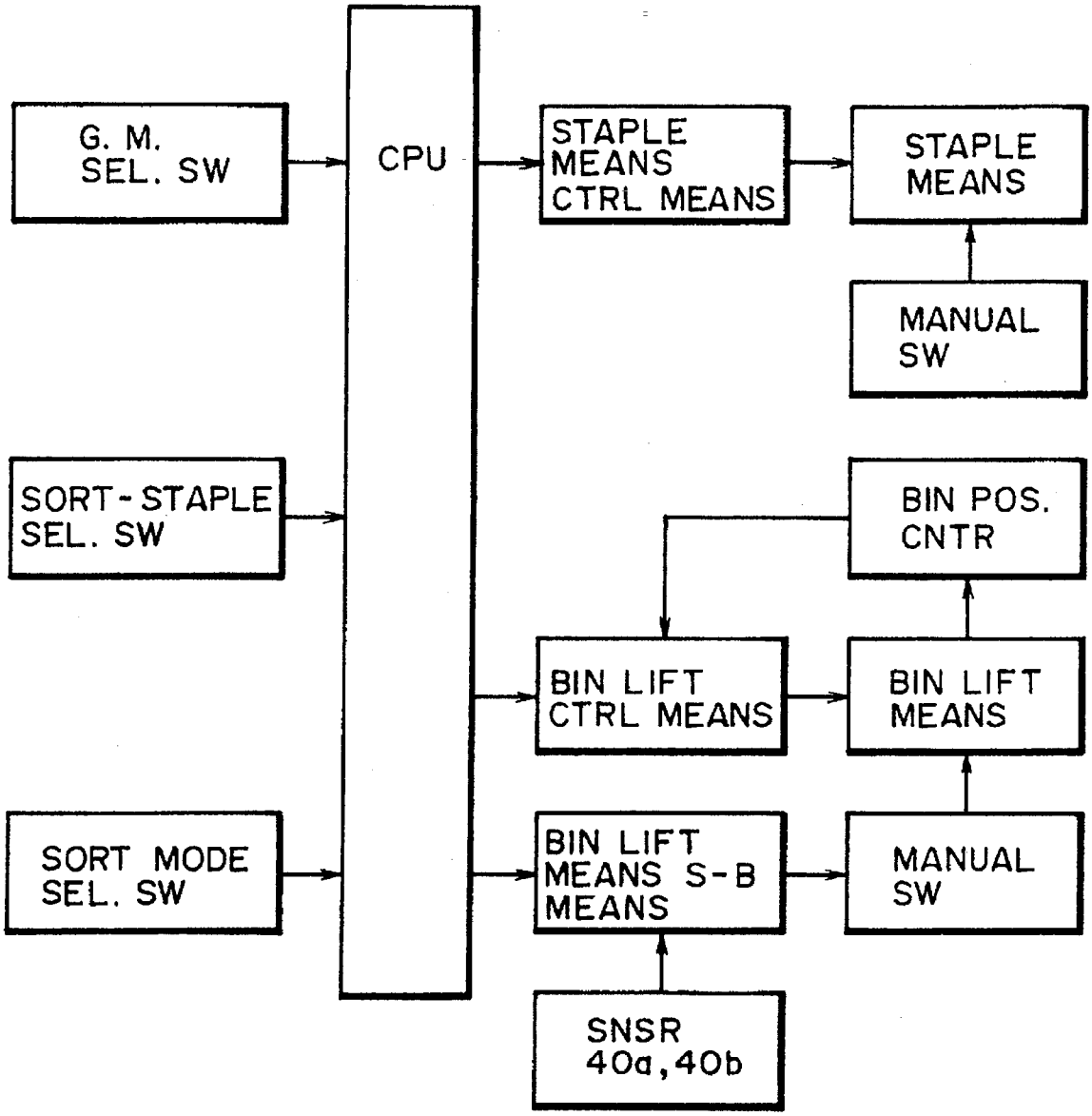
FIG. 15 is a block diagram according to a further embodiment.

After the sheet sorting, the sheets are stapled manually, the bins are moved up manually. The block diagram of the system of this embodiment is shown in FIG. 15.

In the case of an embodiment having both of transfer means and the bin moving means, the bin may be moved up after the sheet set is transferred by the transfer means, or the sheet set may be moved to the easy take-out position after the bin is moved up.

In the case of a sorter, the bin moving means is not inevitable, and the bins may be fixed. It will suffice if only a stand-by control means is provided to prevent automatic operation of the transfer means for transferring the sheet set to the easy take-out position. In this case, the sheets are sorted, and are manually stapled, and then, the sheet sets are manually transferred.

In this case, the stapling means is moved up and down along the bin trays.

In the case of a sorter, the sheet set take-out position is not necessarily the topmost bin position, but may be a slightly higher position than usual. This position is called a predetermined position for taking the sheet out.

While the invention has been described with reference to the structures disclosed herein, it is not confined to the details set forth and this application is intended to cover such modifications or changes as may come within the purposes of the improvements or the scope of the following claims.

What is claimed is:

1. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position; and manual control means for operating said transfer means.

2. An apparatus according to claim 1, further comprising detecting means for detecting one of a presence and an absence of a sheet on said sheet accommodating means, wherein said manual control means is operable while the presence of the sheet is detected by said detecting means.

3. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding sheets; and manual control means for operating said transfer means after operating said binding means.

4. An apparatus according to claim 3, further comprising detecting means for detecting one of a presence and an absence of a sheet on said sheet accommodating means, wherein said manual control means is operable while the presence of the sheet is detected by said detecting means.

5. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding sheets;

first manual control means for operating said binding means; and second manual control means for operating said transfer means after operation of said binding means.

6. An apparatus according to claim 5, further comprising detecting means for detecting one of a presence and an absence of a sheet on said sheet accommodating means, wherein said first and second manual control means is operable while the presence of the sheet are detected by said detecting means.

7. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding sheets;

automatic control means for operating, in an automatic binding mode, said transfer means after operating said binding means after an end of sheet discharge; and manual control means for operating, in a non-automatic binding mode, said transfer means after operating said binding means.

8. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding sheets;

automatic control means for operating, in an automatic binding mode, said transfer means after operating said binding means after an end of sheet discharge; and manual control means for operating, in a non-automatic binding mode, said transfer means.

9. An apparatus according to any one of claims 1–5 and 6–8, wherein said sheet accommodating means comprises sheet accommodating trays arranged in a direction, and said sheet accommodating means is movable in the direction by driving means.

10. An apparatus according to any one of claims 1–5 and 6–8, wherein said sheet accommodating means comprises one sheet accommodating tray.

11. An apparatus according to any one of claims 3–5 and 6–8, wherein said sheet accommodating means comprises a plurality of sheet accommodating trays in a direction, and said binding means is movable in the direction.

12. A sheet post processing apparatus comprising:

at least one sheet accommodating means for accommodating sheets;

sheet discharging means for discharging sheets to said sheet accommodating means;

moving means for moving said sheet accommodating means;

manual control means for effecting an upward movement of said moving means.

13. An apparatus according to claim 12, further comprising detecting means for detecting one of a presence and an absence of a sheet on said sheet accommodating means, wherein said manual control means is operable while the presence of the sheet is detected by said detecting means.

14. A sheet post processing apparatus comprising:

at least one sheet accommodating means for accommodating sheets;

sheet discharging means for discharging sheets to said sheet accommodating means;

moving means for moving said sheet accommodating means;

binding means for binding a set of sheets; and manual control means for effecting an upward movement of said moving means to move upwardly a set of sheets bound by said binding means.

15. An apparatus according to claim 14, wherein said binding means operates in accordance with said manual control means.

16. An apparatus according to claim 14, further comprising detecting means for detecting one of a presence and an absence of a sheet on said sheet accommodating means, wherein said manual control means is operable while the presence of the sheet is detected by said detecting means.

17. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding sheets;

moving means for moving said sheet accommodating means;

manual control means for sequentially operating said binding means, said transfer means and said moving means in the order named.

18. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

moving means for moving said sheet accommodating means;

manual control means for effecting upward movement of said moving means after operating said transfer means.

19. An apparatus according to claims 17 or 18, further comprising detecting means for detecting one of a presence and an absence of a sheet on said sheet accommodating means, wherein said manual control means is operable while the presence of the sheet is detected by said detecting means.

20. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding sheets;

moving means for moving said sheet accommodating means;

manual control means for sequentially operating said binding means, said moving means for upward movement and said transfer means.

21. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

moving means for moving said sheet accommodating means;

manual control means for operating said transfer means after operation of said moving means for upward movement.

22. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding sheets;

moving means for moving said sheet accommodating means;

automatic control means for sequentially operating, in an automatic binding mode, said sheet discharging means, said binding means, said transfer means and said moving means for upward movement in the order named; and manual control means for operating, in a non-automatic binding mode, said binding means, said transfer means and said moving means for upward movement in the order named.

23. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding sheets;

moving means for moving said sheet accommodating means;

automatic control means for sequentially operating, in an automatic binding mode, said sheet discharging means, said binding means, said transfer means and said moving means for upward movement in the order named; and manual control means for operating, in a non-automatic binding mode, said transfer means and said moving means for upward movement in the order named.

24. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding sheets;

moving means for moving said sheet accommodating means;

automatic control means for sequentially operating, in an automatic binding mode, said sheet discharging means, said binding means, said moving means for upward movement and said transfer means in the order named; and manual control means for operating, in a non-automatic binding mode, said binding means, said moving means for upward movement and said transfer means in the order named.

25. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding sheets;

moving means for moving said sheet accommodating means;

automatic control means for sequentially operating, in an automatic binding mode, said sheet discharging means, said binding means, said moving means for upward movement and said transfer means in the order named; and manual control means for operating, in a non-automatic binding mode, said moving means for upward movement and said transfer means in the order named.

26. An apparatus according to any one of claims 12–16, 17 and 18, wherein when said sheet accommodating means is not at a predetermined position for permitting the sheet to be taken out, said moving means operates for upward movement.

27. An apparatus according to any one of claims 12–16, 17 and 18 further comprising a position sensor for detecting a position of said sheet accommodating means, wherein when said sheet accommodating means is not at a predetermined position for permitting the sheet to be taken out, said moving means operates for upward movement.

28. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

sheet size information means for producing an output corresponding to a size of a sheet; and selecting means for selectively operating said transfer means in response to the output of said sheet size information means.

29. An apparatus according to claim 28, further comprising moving means for moving said sheet accommodating means, wherein said moving means is operated for upward movement with operation of said transfer means when said selecting means is operated.

30. An apparatus according to claim 28, further comprising moving means for moving said sheet accommodating means, wherein said moving means is operated for upward movement with operation of said transfer means when said selecting means is not operated.

31. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding a set of sheets;

sheet size information means for producing an output corresponding to a size of a sheet;

automatic control means for operating said transfer means after operation of said binding means after operation of said sheet discharging means; and selecting means for selectively operating said transfer means in response to the output of said sheet size information means.

32. An apparatus according to claim 31, further comprising moving means for moving said sheet accommodating means, wherein said moving means is operated for upward movement with operation of said transfer means when said selecting means is operated.

33. An apparatus according to claim 31, further comprising moving means for moving said sheet accommodating means, wherein said moving means is operated for upward movement with operation of said transfer means when said selecting means is not operated.

34. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding a set of sheets;

sheet size information means for producing an output corresponding to a size of a sheet;

manual control means for operating said transfer means after operation of said binding means; and selecting means for selectively operating said transfer means in response to the output of said sheet size information means.

35. An apparatus according to claim 34, further comprising moving means for moving said sheet accommodating means, wherein said moving means is operated for upward movement with operation of said transfer means when said selecting means is operated.

36. An apparatus according to claim 35, further comprising moving means for moving said sheet accommodating means, wherein said moving means is operated for upward movement with operation of said transfer means when said selecting means is not operated.

37. A sheet post processing apparatus comprising:

at least one sheet accommodating means for accommodating sheets;

sheet discharging means for discharging sheets to said sheet accommodating means;

transfer means for transferring a set of sheets on said sheet accommodating means to a sheet take-out position;

binding means for binding sheets;

automatic control means for operating, in an automatic binding mode, said transfer means after operating said binding means after an end of sheet discharge;

first manual control means for operating, in a non-automatic binding mode, said binding means; and second manual control means for operating said transfer means after operation of said binding means in a non-automatic binding mode.

38. An apparatus according to claim 37, further comprising automatic control means for operating said transfer means.

39. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; and manual control means for operating said transfer means, for post processing a sheet on which an image is formed by said image forming means.

40. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; and manual control means for operating said transfer means after operating said binding means, for post processing a sheet on which an image is formed by said image forming means.

41. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; first manual control means for operating said binding means; and second manual control means for operating said transfer means after operation of said binding means, for post processing a sheet on which an image is formed by said image forming means.

42. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; automatic control means for operating, in an automatic binding mode, said transfer means after operating said binding means after an end of sheet discharge; and manual control means for operating, in a non-automatic binding mode, said transfer means after operating said binding means, for post processing a sheet on which an image is formed by said image forming means.

43. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; automatic control means for operating, in an automatic binding mode, said transfer means after operating said binding means after an end of sheet discharge; and manual control means for operating, in a non-automatic binding mode, said transfer means, for post processing a sheet on which an image is formed by said image forming means.

44. An image forming apparatus comprising:

image forming means for forming an image on a sheet; and a sheet post processing device, comprising at least one sheet accommodating means for accommodating sheets; sheet discharging means for discharging sheets to said sheet accommodating means; moving means for moving said sheet accommodating means; and manual control means for effecting an upward movement of said moving means, for post processing a sheet on which an image is formed by said image forming means.

45. An image forming apparatus comprising:

image forming means for forming an image on a sheet; and a sheet post processing device, comprising at least one sheet accommodating means for accommodating sheets; sheet discharging means for discharging sheets to said sheet accommodating means; moving means for moving said sheet accommodating means; binding means for binding a set of sheets; and manual control means for effecting an upward movement of said moving means to move upwardly the set of sheets bound by said binding means, for post processing a sheet on which an image is formed by said image forming means.

46. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; moving means for moving said sheet accommodating means; and manual control means for sequentially operating said binding means, said transfer means and said moving means in the order named, for post processing a sheet on which an image is formed by said image forming means.

47. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; moving means for moving said sheet accommodating means; and manual control means for effecting upward movement of said moving means after operating said transfer means, for post processing a sheet on which an image is formed by said image forming means.

48. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; moving means for moving said sheet accommodating means; and manual control means for sequentially operating said binding means, said moving means for upward movement and said transfer means, for post processing a sheet on which an image is formed by said image forming means.

49. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; moving means for moving said sheet accommodating means; and manual control means for operating said transfer means after operation of said moving means for upward movement, for post processing a sheet on which an image is formed by said image forming means.

50. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; moving means for moving said sheet accommodating means; automatic control means for sequentially operating, in an automatic binding mode, said sheet discharging means, said binding means, said transfer means and said moving means for upward movement in the order named; and manual control means for operating, in a non-automatic binding mode, said binding means, said transfer means and said moving means for upward movement in the order named, for post processing a sheet on which an image is formed by said image forming means.

51. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; moving means for moving said sheet accommodating means; automatic control means for sequentially operating, in an automatic binding mode, said sheet discharging means, said binding means, said transfer means and said moving means for upward movement in the order named; and manual control means for operating, in a non-automatic binding mode, said transfer means and said moving means for upward movement in the order named, for post processing a sheet on which an image is formed by said image forming means.

52. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; moving means for moving said sheet accommodating means; automatic control means for sequentially operating, in an automatic binding mode, said sheet discharging means, said binding means, said moving means for upward movement and said transfer means in the order named; and manual control means for operating, in a non-automatic binding mode, said binding means, said moving means for upward movement and said transfer means in the order named, for post processing a sheet on which an image is formed by said image forming means.

53. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; moving means for moving said sheet accommodating means; binding means for binding sheets; automatic control means for sequentially operating, in an automatic binding mode, said sheet discharging means, said binding means, said moving means for upward movement and said transfer means in the order named; and manual control means for operating, in a non-automatic binding mode, said moving means for upward movement and said transfer means in the order named, for post processing a sheet on which an image is formed by said image forming means.

54. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; sheet size information means for producing an output corresponding to a size of a sheet; and selecting means for selectively operating said transfer means in response to the output of said sheet size information means, for post processing a sheet on which an image is formed by said image forming means.

55. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; sheet size information means for producing an output corresponding to a size of a sheet; automatic control means for operating said transfer means after operation of said binding means after operation of said sheet discharging means; and selecting means for selectively operating said transfer means in response to the output of said sheet size information means, for post processing a sheet on which an image is formed by said image forming means.

56. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; sheet size information means for producing an output corresponding to a size of a sheet; manual control means for operating said transfer means after operation of said binding means; and selecting means for selectively operating said transfer means in response to the output of said sheet size information means, for post processing a sheet on which an image is formed by said image forming means.

57. An image forming apparatus comprising:

image forming means for forming an image on a sheet; and a sheet post processing device, comprising at least one sheet accommodating means for accommodating sheets; sheet discharging means for discharging sheets to said sheet accommodating means; transfer means for transferring a set of sheets on said sheet accommodating means to a sheet take-out position; binding means for binding sheets; automatic control means for operating, in an automatic binding mode, said transfer means after operating said binding means after an end of sheet discharge; first manual control means for operating, in a non-automatic binding mode, said binding means; and second manual control means for operating said transfer means after operation of said binding means in a non-automatic binding mode, for post processing a sheet on which an image is formed by said image forming means.

* * * * *

UNITED STATES PATENT AND TRADEMARK OFFICE

CERTIFICATE OF CORRECTION

PATENT NO. : 5,657,977

DATED : Aug. 19, 1997

INVENTOR(S) : KATO ET AL.

It is certified that error appears in the above-identified patent and that said Letters Patent is hereby corrected as shown below:

At [57] Abstract, on the title page,

Line 1, "post processing" should read --post-processing--.

Column 1

Line 38, "facilitate" should read --facilitate the--; and

Line 41, "easy-take-out" should read --easy take-out--.

Column 2

Line 29, "is is" should read --is--; and

Line 46, "on a" should read --on--.

Column 4

Line 27, "period," should read --period, a manual stapling switch--; and

Line 67, "sheets" should read --sheet--.

Column 5

Line 24, "part" should read --parts--;

Line 29, "K2," should read --K2--;

Line 38, "detect" should read --detects--;

Line 46, "manually" should read --manually and --; and

Line 49, "of" (second occurrence) should be deleted.

UNITED STATES PATENT AND TRADEMARK OFFICE

CERTIFICATE OF CORRECTION

PATENT NO. : 5,657,977

DATED : Aug. 19, 1997

INVENTOR(S) : KATO ET AL.

It is certified that error appears in the above-identified patent and that said Letters Patent is hereby corrected as shown below:

Column 6

Line 53, "is" should read --are--.

Column 7

Line 18, "claims 1-5 and" should read --claims 1-8,--;
Line 19, "6-8," should be deleted;
Line 23, "claims 1-5 and" should read --claims 1-8,--;
Line 24, "6-8," should be deleted;
Line 26, "claims 3-5 and" should read --claims 3-8,--;
and
Line 27, "6-8," should be deleted.

Column 8

Line 7, "means;" should read --means; and--;
Line 20, "means;" should read --means; and--;
Line 38, "means;" should read --means; and--; and
Line 51, "means;" should read --means.--.

UNITED STATES PATENT AND TRADEMARK OFFICE

CERTIFICATE OF CORRECTION

PATENT NO. : 5,657,977

DATED : Aug. 19, 1997

INVENTOR(S) : KATO ET AL.

It is certified that error appears in the above-identified patent and that said Letters Patent is hereby corrected as shown below:

Column 9

Line 66, "claims 12-16," should read --claims 12-18,--;

and

Line 67, "17 and 18," should be deleted.

Column 10

Line 4, "claims 12-16, should read --claims 12-18,--;

and

Line 5, "17-18," should be deleted.

Signed and Sealed this

Fourteenth Day of April, 1998

Bruce Lehman

*Attest:*

BRUCE LEHMAN

*Attesting Officer*

*Commissioner of Patents and Trademarks*